US005224400A

United States Patent [19]

Maleski

[11] Patent Number: 5,224,400

[45] Date of Patent: Jul. 6, 1993

[54] BROADHEAD TOOL

[75] Inventor: Richard Maleski, Plymouth, Conn.

[73] Assignee: Wasp Archery Products, Inc., Plymouth, Conn.

[21] Appl. No.: 735,827

[22] Filed: Jul. 25, 1991

[51] Int. Cl.[5] ..... B25B 13/00

[52] U.S. Cl. ..... 81/124.2; 81/121.1; 81/176.15; 273/422

[58] Field of Search ..... 81/121.1, 124.2, 176.1, 81/176.15, 176.2, 119; 273/416, 419, 421, 422; 29/240

[56] References Cited

U.S. PATENT DOCUMENTS

| | | | |
|---|---|---|---|
| D. 247,181 | 2/1978 | Hoggard | D22/199 |
| D. 256,606 | 8/1980 | Hoggard | D22/199 |
| D. 276,305 | 11/1984 | Hough, Sr. | D8/71 |
| 673,056 | 4/1901 | Jacobs | 81/176.15 |
| 2,790,473 | 4/1957 | Roper | 273/419 |
| 3,672,677 | 6/1992 | Moore | 273/416 |
| 3,859,728 | 1/1975 | Shutt | 273/416 |
| 3,890,692 | 6/1975 | Jandura, Jr. | 273/416 |
| 4,043,020 | 8/1977 | Hoggard | 273/416 |
| 4,093,230 | 6/1978 | Simo | 273/421 |
| 4,169,454 | 10/1979 | Jones | 273/419 |
| 4,387,697 | 6/1983 | Duke | 273/419 |
| 4,387,805 | 6/1983 | Lanius | 273/422 |
| 4,584,983 | 4/1986 | Ament | 273/416 |

OTHER PUBLICATIONS

"Broadhead Protection", from Archery, Oct. 1972, p. 25.

*Primary Examiner*—Frank T. Yost
*Assistant Examiner*—Hwei-Siu Payer
*Attorney, Agent, or Firm*—Dilworth & Barrese

[57] ABSTRACT

A tool for facilitating the assembly or disassembly of a broadhead from an arrow shaft which substantially reduces or eliminates the potential of injury to a user. A broadhead guide is provided which directs the broadhead into an axial bore having blade engaging slots which securely holds the broadhead in place to allow for rotation of the shaft of the arrow to remove or secure the broadhead to the shaft. Broadhead shank engaging tabs are also provided to facilitate removal of the shank of a broadhead having broken or missing blades.

9 Claims, 5 Drawing Sheets

BROADHEAD TOOL

BACKGROUND OF THE INVENTION

1. Field of the Invention

The present invention relates to arrows and broadheads for arrows, and more particularly to tools for assembling and disassembling the broadhead from the shaft of the arrow.

2. Discussion of the Prior Art

The archery and hunting industries have developed numerous types of arrows having various tips for improving the penetration of the arrow into a target. Typically, the tip of the arrow now comprises a broadhead which includes a pointed tip and a number of razor blade members which are disposed about the circumference of the shank of the broadhead. The broadheads are secured to the arrow shaft by various means, but usually are either crimped onto the end of the shaft or threaded onto the shaft through the provision of screw threads on the broadhead which engage threads on the inner circumference of the hollow arrow shaft. The provision of the screw threads has the added feature of allowing the broadhead to be replaced if the blades are broken or damaged, and it is also known to only replace the broken blades while keeping the original shank of the broadhead for repeated use. This replaceable feature of both the broadhead and the blades represents a great convenience and costsaving feature to the hunter or sportsman by providing a means for easy repair of damaged or broken arrows or broadheads.

Various tools for assembling and disassembling broadheads from arrow shafts are known in the prior art. These devices provide a means for holding the broadhead while the shaft is rotated to remove the broadhead from the shaft. These devices, however, do not provide adequate protection to the user's hand during the assembly or disassembly process, and consequently require extreme care and skill in removing or applying the broadhead to the shaft. Furthermore, many of these devices are bench-mounted, in that they are not portable and necessitate the hunter or sportsman to return from the field to repair the arrow.

In addition, the prior art devices for removing broadheads are only effective for removing broadheads in which the razor blades are intact. It is not uncommon for the precisely machined razor blades to crack or break upon impact with hard objects such as rocks or trees, and thus it is virtually impossible to remove the remaining shank of the broadhead from the arrow, rendering the arrow useless.

An example of such a bench-mounted device for applying or removing broadheads from arrow shafts is disclosed in U.S. Pat. No. 3,859,728 to Shutt. This device provides a means for grasping a broadhead to secure the broadhead to the shaft of the arrow. A similar type of device is disclosed in U.S. Pat. No. 2,790,473 to Roper.

Several portable tools or wrenches which may be carried into the field by a hunter or sportsman to effect the repair and replacement of broadheads to arrow shafts are disclosed in the prior art. In particular, U.S. Pat. No. 4,387,805 to Lanius discloses an arrowhead or broadhead case which also serves as a broadhead wrench for removing or securing a broadhead to an arrow shaft. A case is provided which is opened at one end to accept the broadhead so that the blades of the broadhead are positioned between a series of partitions.

As the shaft is rotated the blades will abut against the partition to allow for rotation of the shaft. During use of this device, however, the user's hand is exposed and it is apparent that the user's hand may be in danger of contacting the sharp tip of the broadhead or the razor sharp blades during insertion of the broadhead into the tool. Furthermore, the initial rotation of the broadhead may cause breaking of the blades as they contact the partitions upon rotation since the blades loosely fit between the partitions. In addition, it is apparent that the device shown in this patent will work only with broadheads having the blades intact. Broadhead shanks having broken or absent blades will not be grasped within the tool of Lanius, and thus may not be repaired without further equipment being available.

Other tools for removing or applying broadheads which suffer the same disadvantages as discussed in view of U.S. Pat. No. 4,387,805 to Lanius includes U.S. Pat. No. De. 256,606 to Hoggard and U.S. Pat. No. De. 276,305 to Hough, Sr. Both of these patents disclose tools which expose the user's hand to potentially serious injury, and both devices will not work with broadheads having broken or absent blades.

As a consequence, the need exists for a portable tool which may allow a hunter or sportsman to quickly and safely remove and repair damaged or broken broadheads from an arrow shaft, while facilitating the reassembly of the broadhead to the shaft with minimal risk of injury to the user's hand. The present invention provides such a device, and allows a hunter or sportsman to facilitate the assembly or disassembly of the broadhead from the arrow shaft in the field through the use of a portable, hand-held tool which safely and efficiently removes the broadhead or assembles the broadhead to the arrow shaft.

The novel broadhead tool for facilitating assembly and disassembly of a broadhead from an arrow shaft obviates the disadvantages encountered in the prior art and provides a safe and efficient broadhead tool which allows the user to effect the repair in the field. The tool of the present invention protects the user's hand and allows the user to repair or replace broadheads in which the blades of the broadhead are intact or where the blades have been broken or removed. The present invention is hand-held and lightweight and may be carried in the pocket or hooked to a belt or jacket.

SUMMARY OF THE INVENTION

The present invention provides a novel tool for assembling or disassembling a broadhead from an arrow shaft which significantly minimizes or eliminates the risk of injury to a user during the repair procedure. Broadheads having any number of blades may be removed or applied to an arrow shaft using the device of the present invention, and the device of the present invention also provides for the removal of broadhead shanks from the arrow shaft in the event that the blades of the broadhead are broken off.

The tool of the present invention is a lightweight hand-held device which may be constructed of a rigid lightweight material such as plastic. The device generally is cylindrical in shape and is provided with a broadhead blade engaging means at a first end. The body portion may have a polygonal cross section, and preferably has a hexagonal cross section which provides a better gripping area for the user's hand, or may facilitate gripping with a wrench or pliers. The broadhead blade engaging means consists of an axially directed bore having a plurality of radially extending slots which extend outwardly from the bore. The bore is of a sufficient diameter to accommodate the shank of the broadhead, while the slots are of such a width so as to permit entry of the blades therein. Preferably, the width of the slots is such so as to secure or frictionally engage the blades to minimize rotational movement of the blades within the slots. The slots may be configured in such a pattern so as to accept broadheads having any number of blade members.

Disposed about the blade engaging means and extending outwardly in an axial direction beyond the blade engaging means is a shroud member which comprises a means for guiding the broadhead into the blade engaging means. The shroud extends from the body of the tool, preferably from a circumferential flange which creates a gripping abutment surface to protect the user's hand. The shroud is provided with a internal taper so as to give the shroud a frusto-conical internal cross section. This internal taper has a shape which corresponds in shape to the cross section of the broadhead, and provides a means for guiding the razor sharp blades and pointed tip of the broadhead into the blade engaging means. Consequently, should a user inaccurately place the broadhead into the tool, his hand will be protected from potentially serious injury by the shroud.

Alternately, the shroud member may have a frusto-conical outer cross section as well as inner cross section so that the shroud extends as a cone or funnel from the first end of the body portion beyond the blade engaging means.

At a second end of the tool, there is provided an axial bore which, in the preferred embodiment, communicates with the axial bore of the blade engaging means to form a common central axial bore. The bore at the second end is provided with at least one tab member, preferably constructed of steel, which extends radially outwardly from the bore so that an inner portion of the tab member is positioned inside the bore. This tab member is used to engage at least one slot in the shank of a typical broadhead which has had its blades broken or removed, to facilitate removal of the shank from the shaft of the arrow.

In use, the user grips the body portion of the device with one hand and feeds the broadhead into the shroud by gripping the arrow shaft with his other hand. The tip of the broadhead is inserted into the axial bore and the blades of the broadhead are aligned with the slots of the blade engaging means so that the broadhead is positioned within the shroud. Preferably, the shroud is of such a length so as to completely enclose the blades of broadhead. Holding the body portion with one hand, the user then rotates the shaft to unscrew the broadhead from the shaft of the arrow.

The tool of the present invention may also be used to remove broadheads which are secured by other means, such as set screws or locking ferules. The tool provides a means for the user to immobilize the broadhead without the risk of potentially serious injury to his hand while gripping the broadhead.

After the broadhead has been removed, a new broadhead may be inserted into the tool in a similar manner so that the user may threadingly rotate the arrow shaft onto the broadhead to secure a new broadhead in place on the arrow shaft.

In order to remove the shank of a broadhead having broken or removed blades, the user inserts the arrow having the broadhead shank to the second end of the tool and aligns at least one of the slots in the shank with the tab member which extends into the bore at the second end. Once the tab is aligned with the slots of the shank, the user may then rotate the shaft to remove the shank from the shaft.

Accordingly, it is an object of the present invention to provide a quick and efficient means for removing broadheads from arrow shafts. It is a further object of the present invention to provide a means for safely removing and applying broadheads to the shaft of an arrow.

It is yet a further object of the present invention to provide a tool for removing broadhead shanks from arrow shafts in which the blades of the broadhead have been broken or removed from the shank.

BRIEF DESCRIPTION OF THE DRAWINGS

The foregoing objects and other features of the present invention will become more readily apparent and may be understood by referring to the following detailed description of an illustrative embodiment of the broadhead tool, taken in conjunction with the accompanying drawings, in which.

DETAILED DESCRIPTION OF THE PREFERRED EMBODIMENTS

Figure 1:
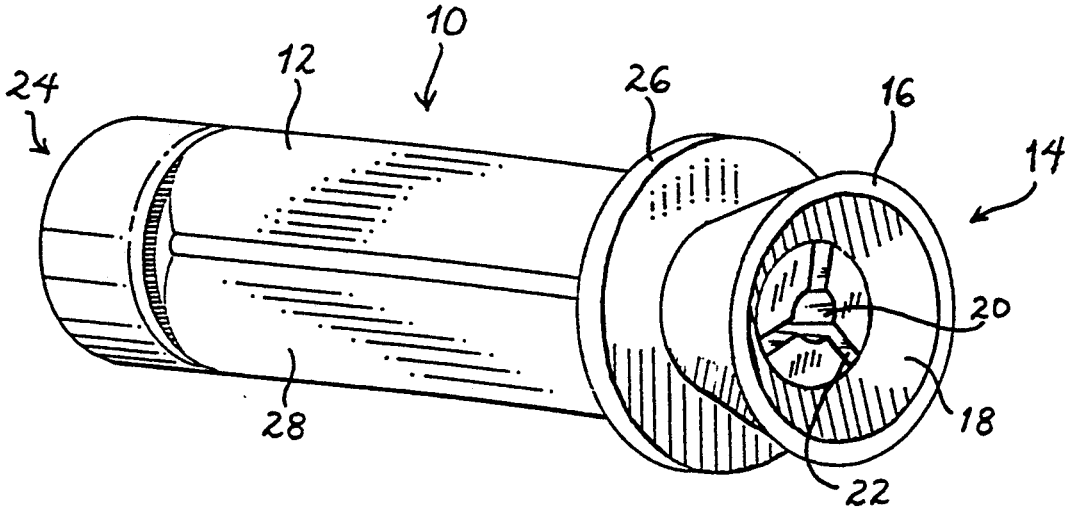
FIG. 1 illustrates a perspective view of a broadhead tool according to the present invention.

Referring now in specific detail to the drawings, in which like reference numerals identify similar or identical elements throughout the several views, FIG. 1 shows a first embodiment of the broadhead tool 10 of the present invention. The broadhead tool 10 has a generally cylindrical body portion 12 which comprises a hand grip for holding and using the tool. Tool 10 is provided at a first end with a broadhead blade engaging means 14. Broadhead blade engaging means 14 essentially comprises an axial bore 20 having a plurality of radially directed slots 22 extending outwardly from bore 20. Bore 20 is of such diameter so as to accommodate the shank of a broadhead, and slots 22 are provided to accommodate the blades of the broadhead. The width of slots 22 is preferably such that the blades of the broadhead are frictionally engaged within slots 22.

Extending axially from body portion 12 beyond blade engaging means 14 is a broadhead guide means 16 which serves to direct the broadhead towards the blade engaging means 14 while providing protection against injury to the user. Broadhead guide means 16 comprises a shroud having a frusto-conical cross section which includes an internal taper 18 which corresponds in shape to the cross section of a broadhead to position the broadhead therein. Broadhead guide means 16 extends a length which is sufficient to completely enclose the blades of the broadhead when the broadhead is positioned therein. This allows the user to handle the tool without the risk of potentially serious injury due to the razor sharp blades of the broadhead.

Flange 26 may be provided to form a gripping abutment surface for the user's hand to prevent slippage of the tool in the direction of the blades. Flange 26 provides further protection for the user in conjunction with broadhead guide means 16, and may be provided with a hole 27 to facilitate hooking the tool onto a belt, jacket, or the like.

Figure 4:
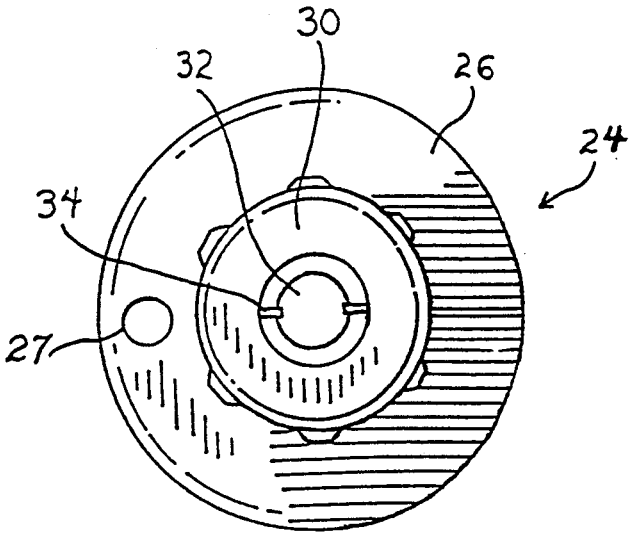
FIG. 4 illustrates a rear plan view of the tool of FIG. 1.
Figure 5:
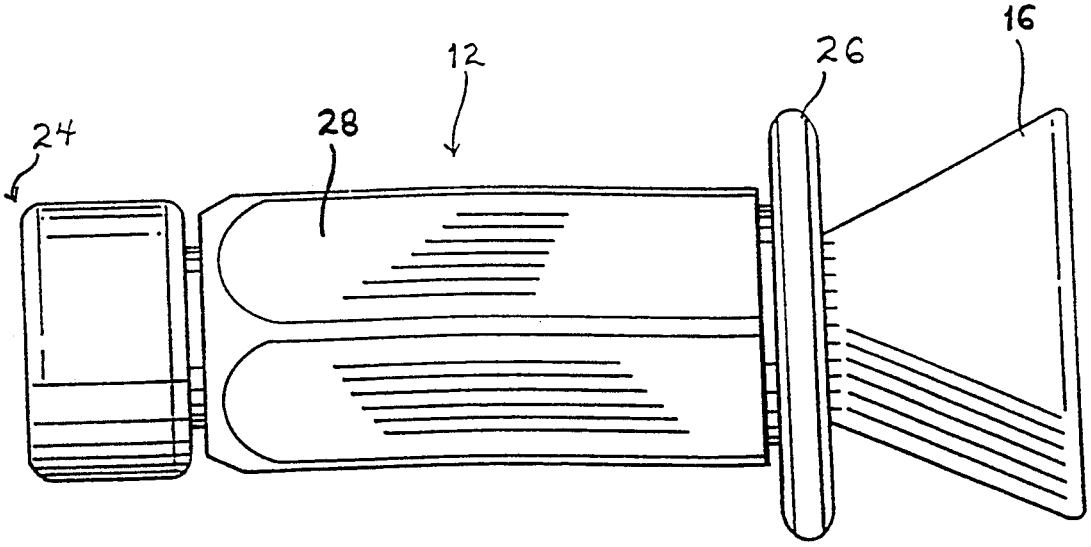
FIG. 5 illustrates a side plan view of the tool of FIG. 1.

As best seen in FIGS. 4 and 5, body portion 12 is provided with a gripping surface 28 which gives the user a tighter grip on the tool during use. Gripping surface 28 provides body portion 12 with a polygonal cross section and preferably provides a hexagonal cross section. Alternately, the cross section of body portion 12 may be circular, and gripping may be enhanced through the provision of a knurled or raised surface, or through the addition of a sleeve member such as rubber or the like. The preferred cross section, however, is hexagonal, which facilitates the use of a tool such as a wrench or pliers in order to provide greater torque to the tool to remove the broadhead from the shaft of an arrow if necessary.

Figure 2:
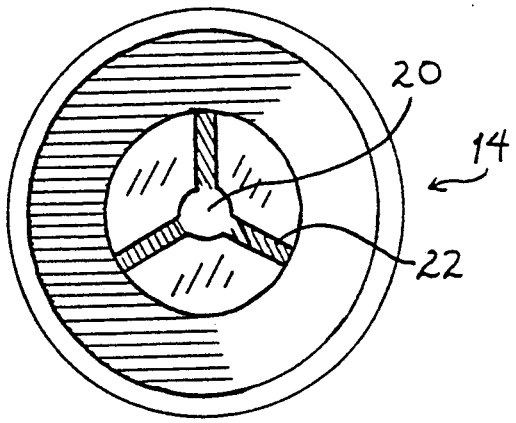
FIG. 2 illustrates a front plan view of the tool of FIG. 1.
Figure 3:
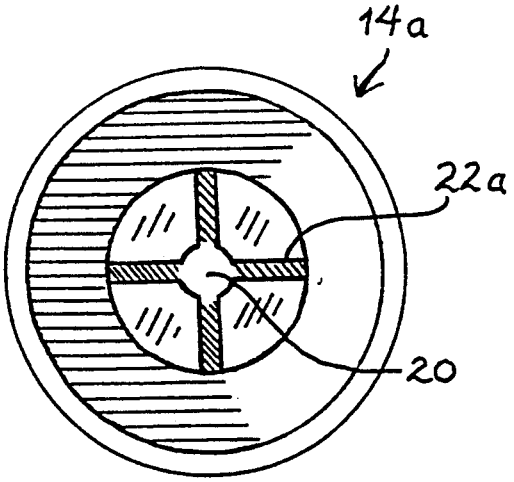
FIG. 3 illustrates a front plan view of an alternate embodiment of the tool of FIG. 1.

FIGS. 2 and 3 further illustrate the blade engaging means of the tool 10. As seen in FIG. 2, central bore 20 is provided having three slots 22 to accommodate a broadhead having three blades. Alternately, as seen in FIG. 3, bore 20 includes four radially directed slots 22*a* to accommodate a broadhead having four blade members.

FIG. 4 illustrates the rear end 24 of tool 10, which includes the means for engaging the shank of a broadhead having broken or missing blades. End wall 30 is provided with an axial bore 32 which extends into the body portion 12 and is of such a diameter so as to accommodate the shank of a broadhead. Axially bore 32 may extend completely through body portion 12 and communicate with axial bore 20 of the blade engaging means. Tab members 34 are provided and extend partially into axial bore 32 to engage the slots in the broadhead shank which are used to secure the blades of the broadhead. In use, the shank is inserted into axially bore 32 so that the slots in the shank align with at least one of the tab members 34 to securely hold the shank while the shaft is rotated to remove the shank.

Figure 6:
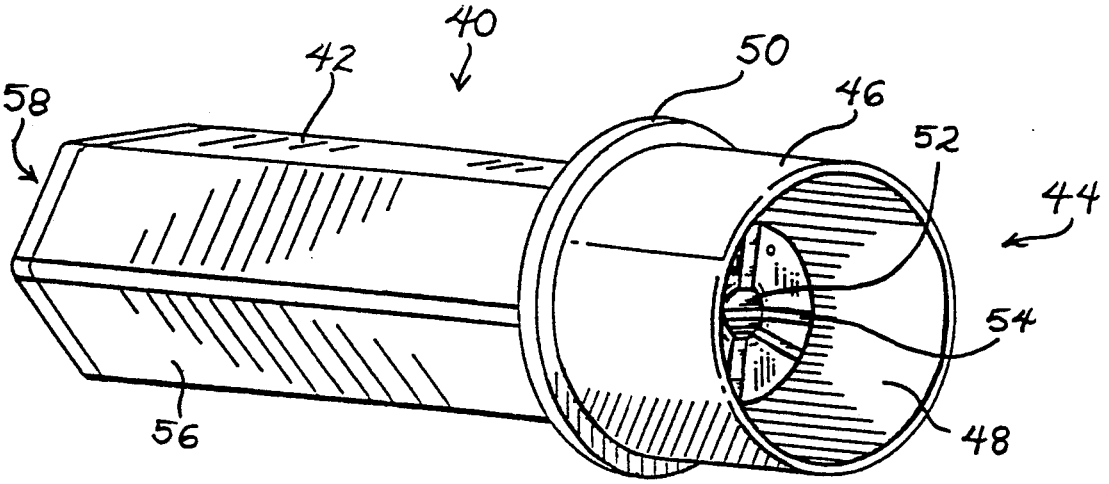
FIG. 6 illustrates a preferred embodiment of the broadhead tool of the present invention.

FIG. 6 illustrates the preferred embodiment of the tool 40 of the present invention. Tool 40 has a body portion 42 which has a polygonal cross section similar to that shown in FIG. 1. The polygonal cross section is preferably a hexagonal cross section, and forms the gripping portion 56 which facilitates handling of the tool. The hexagonal cross section allows for the use of a wrench or pliers to assist in rotation of the tool to remove a broadhead from the shaft of an arrow. Gripping portion 56 ends in a flange member 50 which provides a gripping abutment surface to protect the user's hand. Extending axially from flange 50 is the broadhead guide means 46 which is generally cylindrical in shape and extends axially beyond blade engaging means 44. Broadhead guide means 46 comprises a shroud which is of such a length so as to completely enclose the broadhead during use. The broadhead guide means 46 may have a cylindrical cross section, but preferably has a frustoconical internal cross section which provides an internally tapered guide surface 48 which is of a shape which corresponds to the cross section of a broadhead. Blade engagement means 44 comprises an axial bore 52 having a diameter which is sufficient to accommodate the shank of a broadhead, and includes outwardly directed radial slots 54 for accepting various broadhead blade configurations. Slots 54 are preferably of a width which frictionally engages the blades of the broadhead. Broadhead guide means 46 and flange 50 protect the user's hand from potentially serious injury due to the razor sharp blades of the broadhead; however, it is apparent that flange 50 may be eliminated without sacrificing the safety features of the broadhead guide means 46.

Figure 7:
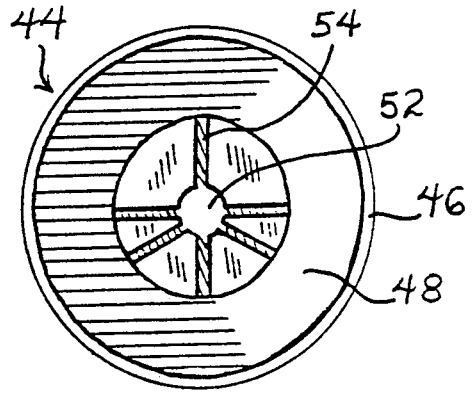
FIG. 7 illustrates a front plan view of the tool of FIG. 6.

FIG. 7 illustrates the blade engaging means 44 of the tool of the present invention. An axial bore 52 is provided having a plurality of slots 54 extending radially outward therefrom. The configuration of the slots shown in FIG. 7 will accommodate broadheads having 2, 3, or 4 blade members. However, it is apparent that the device of the present invention may be constructed so as to accommodate broadheads having any number of blades. Broadhead guide means 46 surrounds and extends beyond blade engagement means 44, such that internal taper surface 48 extends inwardly towards the blade engagement means.

Figure 8:
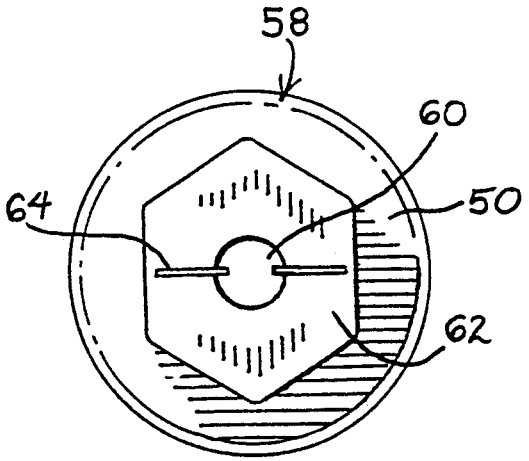
FIG. 8 illustrates a rear plan view of the tool of FIG. 6.
Figure 9:
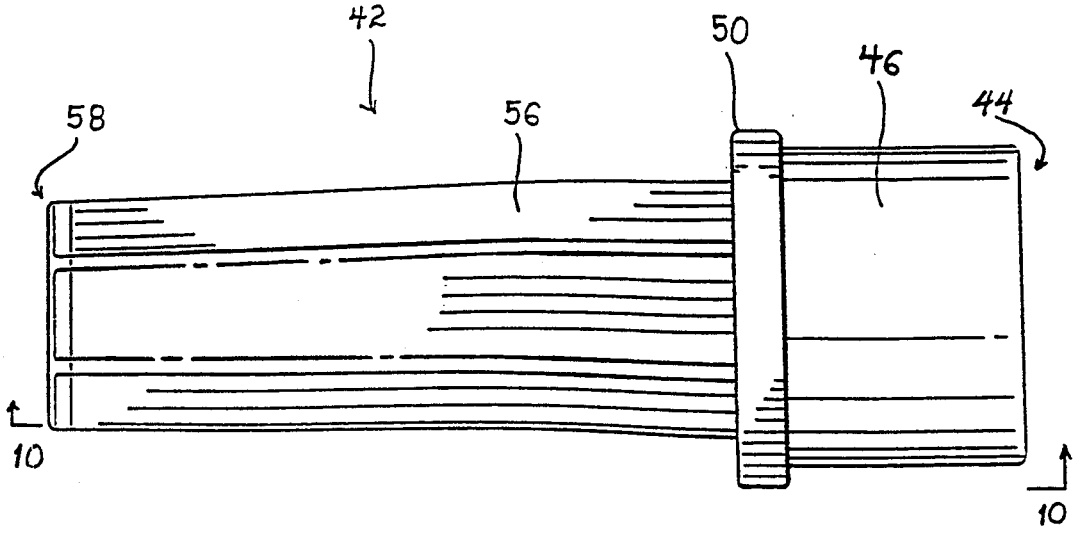
FIG. 9 illustrates side plan view of the tool of FIG. 6.
Figure 10:
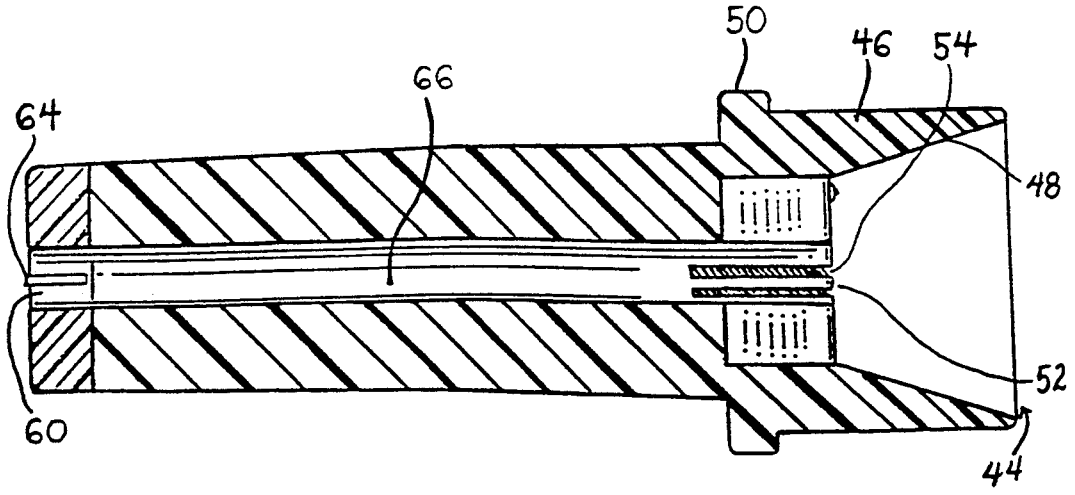
FIG. 10 illustrates a side cross-sectional view of the tool of FIG. 9 taken along lines 10—10.

FIG. 8 illustrates a shank engagement means positioned at the second end 58 of tool 40. End wall 62 is provided with an axial bore 60 which may extend through body portion 42 to communicate with axial bore 52 to create a central longitudinal bore. Central bore 66 is best seen in FIG. 10. Extending radially outwardly from bore 60 is at least one tab member 64, which is preferably constructed of steel and which is provided to engage the slot in the shank of a broadhead having its blade members broken or missing. Bore 60 is of a diameter sufficient to accommodate the shank of a broadhead, and once positioned therein, one of the slots is aligned with one of the tabs 64 to securely hold the shank while the shaft of the arrow is rotated to remove the shank therefrom.

Figure 11:
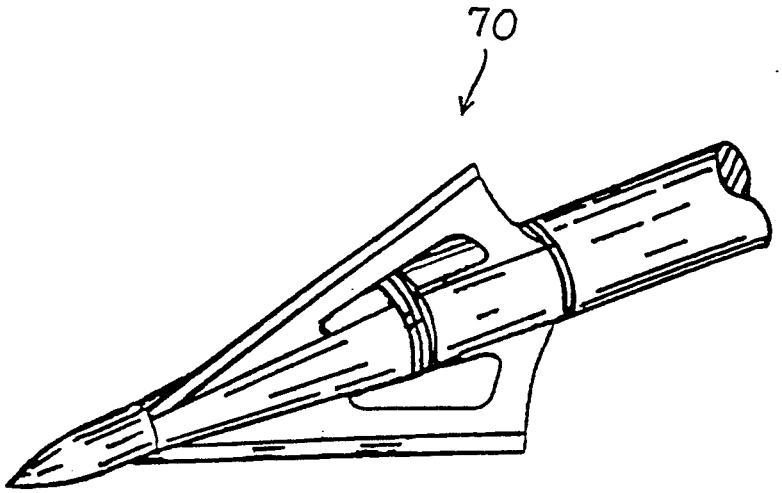
FIG. 11 illustrates a typical broadhead attached to an arrow shaft.

FIG. 11 illustrates a typical broadhead 70 attached to the shaft of an arrow which may be removed by the tool of the present invention. In use, the broadhead is inserted into the broadhead guide means 46 so that the tip enters bore 52 of the blade engagement means 44. The internally tapered surface 48 of guide means 46 directs the tip of the broadhead and the blades towards bore 52 and slots 54. While holding tool 40 by gripping portion 56, the user then aligns the tip of the broadhead with bore 52 and the blades of the broadhead with slots 54 and fully inserts the broadhead into the guide means 46. The internal taper 48 is such so as to align with the taper of the blades so that there is no radial movement of the broadhead within the tool. The width of the slots is such that there is no rotational movement of the broadhead, so that the user may rotate the shaft of the arrow while securely holding the broadhead within the tool so that the shaft may be rotated to remove the broadhead from the shaft. Once the broadhead is removed, a new broadhead may be inserted into the tool and the shaft rotated onto that broadhead to reassemble the arrow.

The broadhead tool of the present invention is a device which quickly and efficiently removes broadheads from arrow shafts and which also may remove shanks of broadheads having broken blades from the shaft of an arrow while protecting the user from potentially serious injury by eliminating exposure of the razor blades and pointed tip of the broadhead. The device is lightweight and may easily be carried in a pocket or on a belt of a hunter or sportsman.

While the invention has been particularly shown and described with reference to the preferred embodiments, it will be understood by those skilled in the art that various modifications and changes in form and detail may be made therein without departing from the scope and spirit of the invention. Accordingly, modifications such as those suggested above, but not limited thereto, are to be considered within the scope of the invention.

What is claimed is:

1. A tool for facilitating assembly and disassembly of a broadhead from an arrow shaft, comprising:

a generally cylindrical body portion;

means at a first end of said body portion for engaging blades of a broadhead;

means at a second end of said body portion for engaging slots in a shank of a broadhead having absent blades; and means for guiding a broadhead into said blade engaging means disposed on said body portion adjacent said first end to permit rotation of said shaft to remove said broadhead.

2. A tool according to claim 1, wherein said body portion includes a central axial bore extending therethrough.

3. A tool according to claim 1, wherein said central axial bore joins said blade engagement means with said shank engagement means.

4. A tool according to claim 1, wherein said body portion includes an axial bore at a first end having a diameter sufficient to accommodate a shank of a broadhead.

5. A tool according to claim 4, wherein said means for engaging said blades comprises a plurality of radially directed grooves extending outwardly from said axial bore, said grooves having a width sufficient to frictionally engage said blades.

6. A tool according to claim 1, wherein said body portion includes an axial bore at a second end having a diameter sufficient to accommodate a shank of said broadhead.

7. A tool according to claim 6, wherein said means for engaging a broadhead shank comprises at least one axially directed tab member outwardly extending from said axial bore for engaging slots in said shank of a broadhead having absent blades.

8. A tool according to claim 1, wherein means for guiding said broadhead comprises a shroud member extending axially beyond said blade engagement means, said shroud having a frusto-conical internal cross section corresponding in shape to a broadhead to guide said broadhead into said blade engagement means to protect a user.

9. A tool according to claim 1, further comprising a circumferential flange member disposed about said body portion to provide a grip portion.

* * * * *

UNITED STATES PATENT AND TRADEMARK OFFICE

CERTIFICATE OF CORRECTION

PATENT NO. : 5,224,400

DATED : July 6, 1993

INVENTOR(S) : Richard C. Maleski

It is certified that error appears in the above-identified patent and that said Letters Patent is hereby corrected as shown below:

Column 8, line 1, "1" should be --2--.

Signed and Sealed this

Twenty-second Day of March, 1994

Bruce Lehman

*Attest:*

BRUCE LEHMAN

*Attesting Officer*

*Commissioner of Patents and Trademarks*